US008329966B2

(12) United States Patent
Tsai et al.

(10) Patent No.: US 8,329,966 B2
(45) Date of Patent: Dec. 11, 2012

(54) SLIGHTLY BRANCHED DIALKYL BENZENES AND RELATED COMPOSITIONS

(75) Inventors: Chi-Hsing Tsai, Taipei (TW); Chien-Hsun Tsai, Taipei (TW)

(73) Assignee: Formosan Union Chemical Corp., Taipei (TW)

( * ) Notice: Subject to any disclaimer, the term of this patent is extended or adjusted under 35 U.S.C. 154(b) by 426 days.

(21) Appl. No.: 11/907,273

(22) Filed: Oct. 10, 2007

(65) Prior Publication Data

US 2008/0103071 A1 May 1, 2008

Related U.S. Application Data

(60) Provisional application No. 60/854,102, filed on Oct. 25, 2006.

(51) Int. Cl.
*C10M 105/06* (2006.01)
*C10M 111/02* (2006.01)

(52) U.S. Cl. ..... 585/24; 585/446; 585/448; 585/455; 508/110; 508/591; 208/18; 208/19

(58) Field of Classification Search ..... 585/24, 585/446, 448, 455; 508/110, 591; 208/19
See application file for complete search history.

(56) References Cited

U.S. PATENT DOCUMENTS 3,169,928 A 2/1965 Herold
3,173,965 A 3/1965 Pappas et al.
3,478,113 A 11/1969 Bray et al.
4,148,834 A 4/1979 Kennedy et al.
5,132,477 A * 7/1992 Ho et al. ..... 585/467
5,254,274 A * 10/1993 Ho et al. ..... 508/584
5,851,272 A * 12/1998 Vicenzi ..... 106/11
6,491,809 B1 12/2002 Briot et al.
6,869,917 B2 3/2005 Deckman et al.
7,563,938 B2 * 7/2009 Campbell et al. ..... 585/24
2006/0142626 A1 * 6/2006 Campbell et al. ..... 585/24
2007/0142686 A1 * 6/2007 Campbell et al. ..... 585/459
2007/0282143 A1 * 12/2007 Driver et al. ..... 585/24

* cited by examiner

*Primary Examiner* — Ellen McAvoy

(74) *Attorney, Agent, or Firm* — Birch, Stewart, Kolasch & Birch, LLP

(57) ABSTRACT

Synthetic base oil composition comprising dialkyl aromatic compound with alkyl side chain carbon number from $C_{10}$ to $C_{28}$, or preferably $C_{11}$ to $C_{24}$, or even more preferably, $C_{12}$ to $C_{18}$, wherein the branching characteristics of the alkyl side chain has a total methyl number (TMN) determined by $C^{13}$ NMR spectroscopy to be from more than 2.1 to less than 3.5, or preferably from 2.15 to 3.25, or even more preferably from 2.2 to 3.0, or a branching index (BI) from more than 0.1 to less than 1.5, or more preferably, 0.15 to 1.25, or even more preferably, 0.2 to 1.0. The synthetic base oil composition has a combination of high viscometric index, low volatility, superior low temperature properties, and improved thermal/oxidation stability, and is particularly suitable to be used as a premium synthetic base stock, second base oil component, or additive for lubricant and additive package applications.

17 Claims, 4 Drawing Sheets

SLIGHTLY BRANCHED DIALKYL BENZENES AND RELATED COMPOSITIONS

CROSS-REFERENCE TO RELATED APPLICATION

This application claims priority under 35 U.S.C. §119(e) to provisional application Ser. No. 60/854,102, which was filed on Oct. 25, 2006. The entire disclosure of application Ser. No. 60/854,102 is expressly incorporated by reference herein.

FIELD OF THE INVENTION

This invention relates to synthetic base oil compositions comprising aromatic compounds with two long alkyl side chains—i.e., having carbon numbers from $C_{10}$ to $C_{28}$—wherein the long alkyl side chains have precisely defined branching characteristics. The synthetic base oil compositions of this invention have a combination of high viscometric index, low volatility, superior low temperature properties, and improved thermal/oxidation stability. They are particularly suitable for use as premium synthetic base stock, as a second base oil component, as diluents, or as additives for lubricant, fuel, and additive package applications.

BACKGROUND OF THE INVENTION

High viscometric index, low volatilities, superior low temperature as well as thermal/oxidative stabilities are those of the most desirable and essential performance characteristics exhibited by synthetic lubricant base stocks such as polymerized alpha olefin base oils known/abbreviated as PAO. For instance, U.S. Pat. No. 6,869,917 teaches the use of PAO in the formulation of synthetic engine oil wherein PAO was claimed to exhibit viscometric index of, preferably, greater than 120, Selby-NOACK (abbreviated as NOACK) volatility from 4 to about 12%. A minimum NOACK volatility specification of 13% will be required for the future heavy diesel engine requirements. The value 13% NOACK is the diesel lubricant specification proposed by Cummins in 2007, and cited as the minimum volatility for diesel engine oil other than 10W grades, by ACEA, EMA, and JAMA associations, Global Performance Specification for light duty diesel engine oil. Additionally, PAO was recognized as a wax free, synthetic composition with superior low temperature properties which are important for engine oil applications as it enhances engine oil pumpability/start up performance especially in cold climate conditions, and for a number of lubricant and additive applications that has no tolerance of crystallization/wax formation at low temperatures. Refrigeration oil is an example that requires wax-free and outstanding low temperature properties, described in detailed in the Research Report sponsored by Air-Conditioning Research Institute, titled "Using Acid Number as indicator for refrigeration system performance", ARTI-21CR/611-500, Final Report, 1993. Substantially linear alkylphenols are proposed to ensure the wax free operations, see U.S. Pat. No. 5,600,025. For instance, the minute presence of waxy components in refrigeration oils is known to cause the capillary blockage and thus system failures. Waxy constitute in lubricants and additives can plug the in-line filtering devices in additive distribution systems and the fuel or lube systems of actual operating engines. Such a plugging would obviously be catastrophic and must be avoided.

Viscometric index higher than 120 is also the critical performance specification that separates GIII base oil, one of the highest categories of mineral oil based products, from that of lower grade GI and GII base oils. Because of this improvement and other performance benefits that are comparable to PAO with the exception in the region of low temperature properties, GIII base oil today is considered as "synthetic" base stock in Europe and North America.

Despite these good performance characteristics, the above mentioned synthetics including PAO and GIII base oils, have a poor solvency toward additive and hence often require a second base oil component such as ester or other oxygen containing base oils such as oil-soluble PAG or polar base stock such as carbonates. See "Esters in Synthetic Lubricants and High Performance Functional Fluids" (2nd. ed.), Rudnick L R and Shubkin R L (eds.), Marcel Dekker, New York, pp. 63-101. Esters have good additive solvency, however, is prone to hydrolysis and thermal/oxidative breakdown resulting in high acid/sludge formation tendency. Oil soluble PAG or other polar base stocks offer some performance benefits, however, are often hygroscopic and problematic with compatibility with system components and the rest of the lubricant itself. Accordingly it is highly desirable to have a synthetic fluid that shall meet all of the above performance requirements and in the meantime to provide the additional performance features such as built-in solvency toward additives.

Synthetic heavy alkyl benzene fluids, hereinafter referred as "heavy alkylates", are commercially known as the by-products isolated from the detergent alkylate production by reacting olefins or paraffins feedstock with benzene. See the Handbook of Petroleum Refining Processes, McGraw-Hill, New York, Second Edition, 1977, by R. A. Meyers, pages 153-166. These heavy alkylates provide built-in solvency, excellent low temperature properties, and improved thermal/oxidative stability when compare with petroleum derived mineral oils, however, exhibit generally poor viscometric index and high volatility due to the fact that they contain a significant portion of isomerized/rearranged products other than the re-alkylated product of the detergent alkylate that include dialkylbenzene (abbreviated as DAB) as well as higher alkylates. For instance, heavy alkylates based on branched olefins such as propylene tetramers gave poor VI less than 30 to even negative values, while heavy alkylates based on linear olefins gave viscometric index generally between 40 and 110 that is not any better than those of the traditional mineral oil based products. Because of these deficiencies the use of heavy alkylates are used as the synthetic substitutes for naphthenic oils and are limited to applications where it does not place high demand on volatilities and viscometric index such as those in hermetically sealed systems, e.g., refrigeration oil, heat transfer and insulating fluid applications.

U.S. Pat. No. 3,173,965 discloses the high yield synthesis of DAB with a minimum of viscometric index of no less than 95 and a pour point of no more than 15° F. (−9.4° C.) through a two-step alkylation process in the presence of Friedel Crafts liquid acid catalysts such as HF, $AlCl_3$, $BF_3$, etc. Suitable alkylating agents include pure linear alpha olefins or olefins made by wax or petrolatum cracking processes.

U.S. Pat. No. 4,148,834 further teaches the use of $AlCl_3$ or $AlBr_3$ in the above second step alkylation process wherein it improves the viscometric index of products that are made with HF catalyst.

U.S. Pat. No. 3,288,716 discloses the use of by-product alkylate bottom with a minimum viscosity index of at least 90, a −40° C. viscosity of no higher than 25,000 cSt. and a pour point of at least—70° C., and a flash point of at least 430° F.

U.S. Pat. No. 4,011,166 describes the simultaneous polymerization-alkylation process by reacting shorter chain linear alpha olefins with benzene. Such chemistry gives alkylate products with much higher viscosity and somewhat improved viscometric index but not the low temperature properties wherein patentee points out the difficulties in improving pour points when carbon number is C14 and above.

U.S. Pat. No. 6,491,809 teaches the production of DAB through the use of shape-selective solid catalysts by reacting benzene with linear alpha olefins. The shape-selectivity of the catalysts minimizes the alkyl side chain isomerization and enables the exclusive formation of DAB with exceptionally high 2-linear isomer content. The formation of high 2-linear isomer content gives the high viscometric index; however, it results in a DAB product with exceptionally high pour points, poor cold cranking viscosity, as well as high crystallization tendency at temperature as high as 0° C.

The present invention discloses the use of olefins with slight/controlled degree of branching, hereinafter called Slightly Branched Olefins, in the production of the DAB composition with a surprising and novel combination of performance benefits unmatched by the heavy alkylates as well as those described in the prior arts of the above. This combination of performance benefits qualifies the DAB composition of the present invention as a stand-alone and premium synthetic base stock for a broad range of lubricant applications. It's built-in benzene moiety provides the inherent solvency toward additives as well as additional performance benefits such as improved lubricity with and without additives, and hence it can also be used as ester replacements as a second base oil or additive component.

SUMMARY OF THE INVENTION

In an embodiment of the invention, slightly branched DAB compositions are provided, which comprises primarily the di-alkylation products by reacting benzene in the presence of solid acid catalysts with Slightly Branched Olefins, wherein the olefins have carbon number ranged from C10 to C28, or C11-C24, or even more preferably C12-C18.

In an embodiment of the invention, the branching characteristics of the slightly branched DAB are determined as follows:

$$TMN = \frac{\text{Averaged chain length}}{\text{Carbon number}} \cdot \times \frac{i.\ \text{Sum of integrated areas for all methyl groups}}{\text{Total integration area for all aliphatic carbons}}$$

$$BI = TMN \text{ minus } 2(\text{two terminal methyl carbons})$$

In an embodiment of the invention, the branching characteristics of the slightly branched DAB is defined by the "total methyl numbers (abbreviated as TMN)" determined by $C^{13}$ NMR spectroscopy to be from 2.1 to 3.5, preferably from 2.15 to 3.25, or even more preferably from 2.2 to 3.0.

In an embodiment of the invention, the Slightly Branched Olefins of the present invention are characterized by the "branching index (abbreviated as BI)" defined by the degree of the branching wherein BI is determined to be from more than 0.1 to less than 1.5, or more preferably, 0.15 to 1.25, or even more preferably, 0.2 to 1.0.

In an embodiment of the invention, the Slightly Branched Olefins of the present invention can be either terminal, internal, or vinylidene type, or a mixture that contains at least one of such functionality types prepared under the isomerization/alkylation conditions with appropriate catalysts known in the art.

In another embodiment of the invention, the slight branched olefins of the present invention can be selected from a single carbon range, such as C10, C11, C12, C13, C14, or C15 alike, or a mixture of different carbon ranges.

In an embodiment of the invention, the Slightly Branched Olefins are obtained by the pre-isomerization of linear alpha olefins to olefins with desired branching characteristics, or through the dehydrogenation of paraffins followed by skeleton isomerization, or dehydrogenation of isoparaffins with desired branching characteristics generated by methods known in the arts, or alternatively, they can be generated in-situ via a simultaneous alkylation/isomerization process giving rise to appropriate branching characteristics desired by the present invention.

In another embodiment of the invention, the Slightly Branched Olefins of the present invention can be prepared through olefin oligomerization such as hexene/octene dimerization or other chemistry such as Fischer Tropsch reactions known in the arts, to achieve desired branching, or through blending of olefins with different branching characteristics, for instance, by combing linear alpha olefins with branched olefins that can be selected from above.

In an embodiment of the invention, the slightly branched DAB contains a mixture of poly-alkylated products that may be a di-, tri-, or higher alkylates, with DAB content greater than 85% and mono-alkylates content less than 0.5%.

In an embodiment of the invention, the slightly branched DAB displays a novel and surprising combination of performance characteristics including a minimum viscometric index of 120, a maximum pour point of −40° C., a Selby-NOACK ("NOACK") volatility of no higher than 13%, and a cold cranking stimulated ("CCS") viscosity at −40° C. of no higher than 20,000 cp.

The DAB composition obtained in accordance with embodiments of the invention may be hydro-finished, clay treated, or processed to improve its color and appearance and can be used to formulate into lubricant oils in amounts from about 1% to 100%. The lubricant oils may contain a number of additives and/or other base oils in amounts required to provide various functions desired by specific lubricant applications.

In one embodiment, this invention provides a synthetic base oil composition comprising a dialkyl aromatic compound with alkyl side chain carbon number from C10 to C28, wherein the branching characteristics of the said alkyl side chain has a total methyl number (TMN) determined by $C^{13}$ NMR spectroscopy to be from more than 2.1 to less than 3.5 or a branching index (BI) from more than 0.1 to less than 1.5. This synthetic base oil composition has a combination of high viscometric index, low volatility, superior low temperature properties, and improved thermal/oxidation stability that makes it suitable as a premium synthetic base stock, second base oil component, and additive for lubricant and additive package applications. The synthetic base oil composition of this invention may be used in synthetic lubricant applications as base oil or additive component at a concentration from 1% to 99%.

BRIEF DESCRIPTION OF THE DRAWINGS

In order to assist in the understanding of the present invention, reference is now made to the appended drawings. The drawings are intended to be exemplary only, and should not be construed as limiting the invention.

DESCRIPTION OF PREFERRED EMBODIMENTS

Figure 1A:
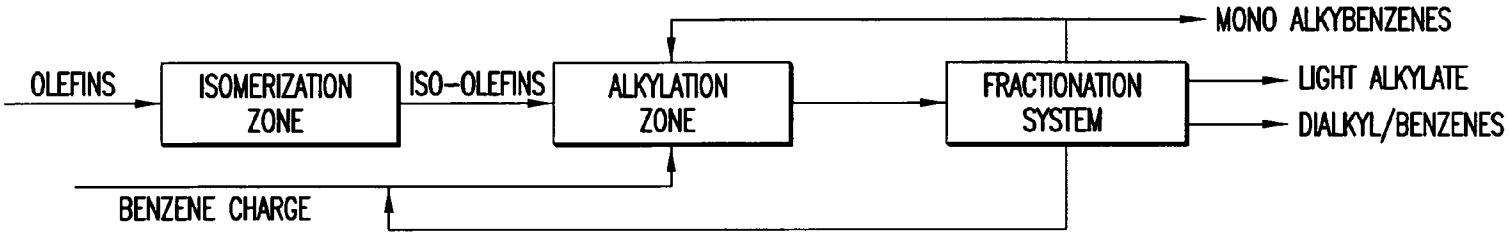
FIG. 1A is a process flow chart illustrating formation of Slightly Branched Olefins via direct olefin isomerization.
Figure 1B:
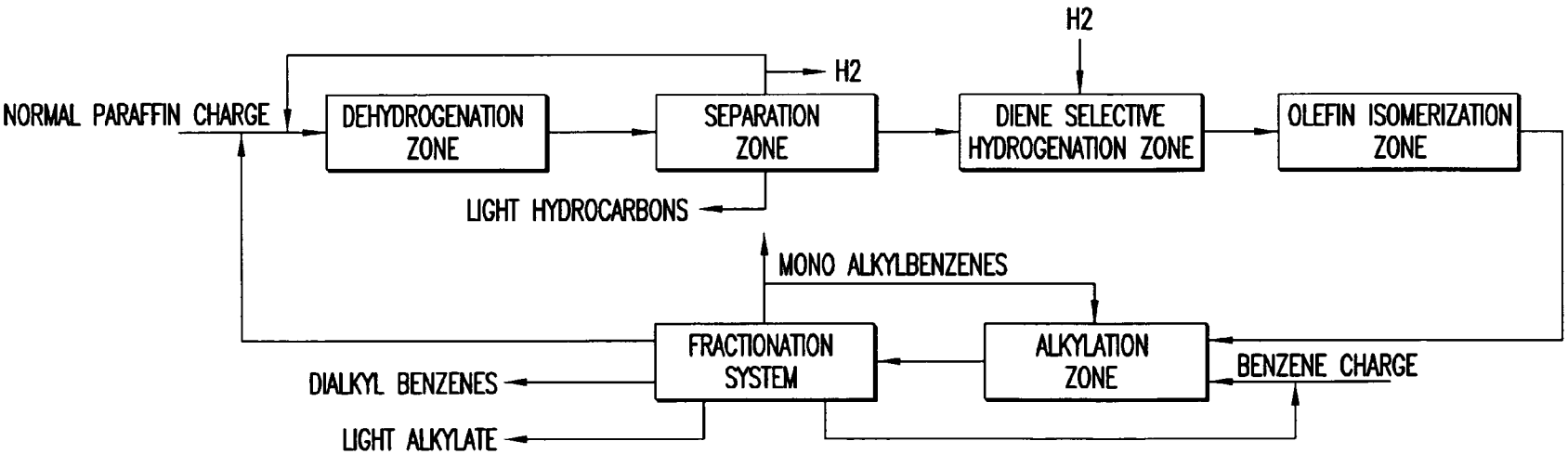
FIG. 1B is a process flow chart illustrating formation of Slightly Branched Olefins via dehydrogenation of paraffins followed by olefin isomerization.
Figure 1C:
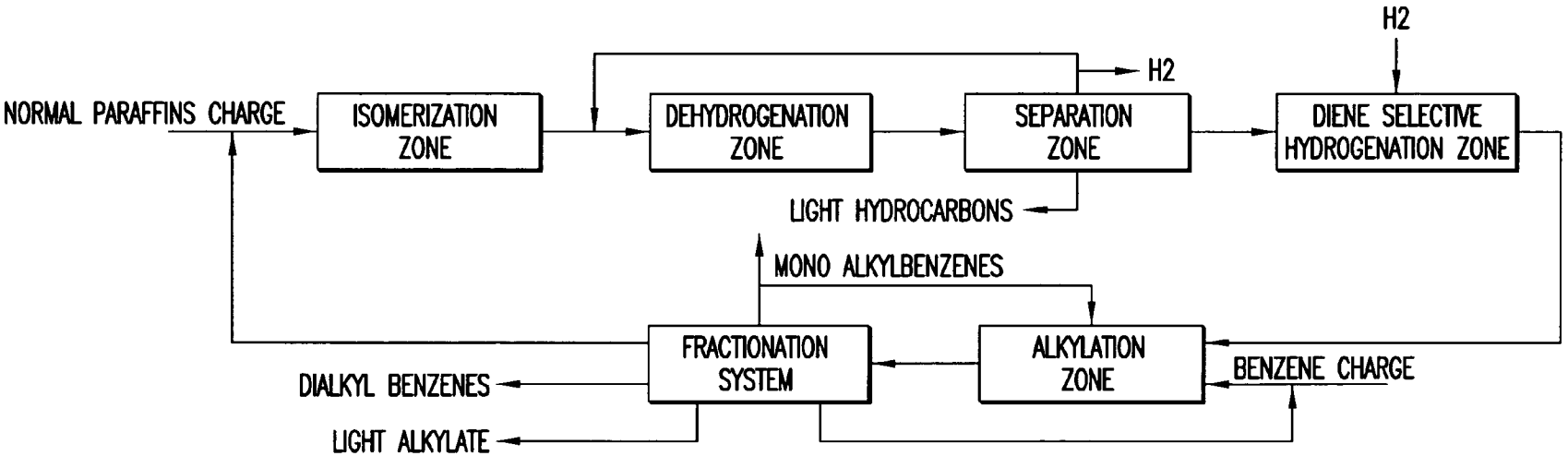
FIG. 1C is a process flow chart illustrating formation of Slightly Branched Olefins via dehydrogenation of isoparaffins with desired branching.
Figure 1D:
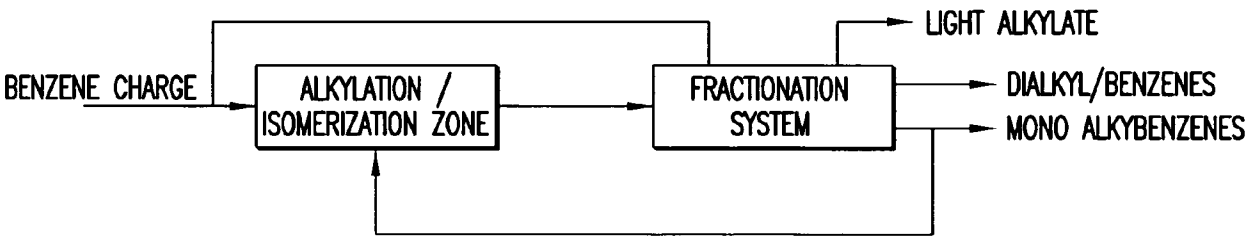
FIG. 1D is a process flow chart illustrating formation of Slightly Branched Olefins via in situ formation of isomerized/Slightly Branched Olefin followed by in situ alkylation with benzene.

This invention provides a synthetic base oil composition comprising a dialkyl aromatic compound having an alkyl side chain carbon number from $C_{10}$ to $C_{28}$, preferably from $C_{11}$ to $C_{24}$, more preferably from $C_{12}$ to $C_{18}$. In accordance with the present invention, the branching characteristics of the dialkyl side chains has a total methyl number ("TMN") determined by $C^{13}$ NMR spectroscopy of from more than 2.1 to less than 3.5 or has a branching index ("BI") of from more than 0.1 to less than 1.5. In preferred embodiments, the TMN of said dialkyl aromatic compound is from 2.15 to 3.25 or wherein the BI is from 0.15 to 1.25. In more preferred embodiments, the TMN of said dialkyl aromatic compound is from 2.2 to 3.0 or wherein the BI is from 0.2 to 1.0. In most cases, the content of dialkyl aromatic compound is at least 85% by weight, based on the total weight of the synthetic base oil composition. The aromatic compound is a member selected from the group consisting of benzene, toluene, biphenyl oxide, biphenyl, anisole, naphthalene, and methylnaphthalene.

As explained in more detail hereinbelow, the synthetic base oil composition of this invention typically has a minimum viscometric index of 120, a maximum pour point of −40° C., a Selby-NOACK ("NOACK") volatility of no higher than 13%, and a cold cranking stimulated ("CCS") viscosity at −40° C. of no higher than 20,000 cp.

The synthetic base oil composition of this invention may further comprises additional synthetic alkylates which are linear or branch types. Thus, for example, the present synthetic base oil composition can further comprise a second synthetic base oil selected from the group consisting of polymerized alpha olefin base oil and mineral oil. Additionally, the present synthetic base oil may further comprise a lubricant additive.

Another embodiment of the invention is a method of making the synthetic base oil composition described herein. This method comprises alkylating an aromatic compound with an olefin that is linear, terminal, internal, vinylidene, or branch type, or a mixture thereof, and isomerizing the resulting alkylated aromatic compound to provide the specified branching characteristics in said alkyl side chains. These alkylating step and isomerizing steps may be carried out in the presence of solid acid catalyst selected from the group consisting of clay, amorphous silica-alumina, and zeolite in a recycle mode or two steps mode to produce said dialkyl aromatic compound in major amounts.

In one variation of this method, the alkylating step and isomerizing steps are carried out in a recycle mode or in a two steps mode to produce the desired dialkyl aromatic compound in major amounts. In another variation of this method, the olefin is prepared by the steps of: a) isomerizing a paraffin to produce an isoparaffin, b) dehydrogenating the resulting isoparaffin-containing stream to produce a mono-olefin-containing stream, and c) selectively hydrogenating the mono-olefin stream to remove dienes and to produce mono-olefins having the specified branching characteristics required for said alkyl side chains. In yet another variation of this method, the olefin is prepared by the step of: conducting a shape-selective olefin oligomerization and/or isomerization process to produce mono-olefins having the specified branching characteristics required for said alkyl side chains. Additional variations of this method include preparing the olefin by the step of: conducting a Fischer-Tropsch process to produce mono-olefins having the specified branching characteristics required for said alkyl side chains, and preparing the olefin by the step of: blending and/or mixing linear and branch olefins to produce mono-olefins having the specified branching characteristics required for said alkyl side chains.

The products of the processes described herein constitute still further embodiments of the invention described and claimed in the present application.

Two types of feedstock employed in the present invention to prepare said dialkyl aromatic compound composition are an aromatic compound and a Slightly Branched Olefin. In accordance, for instance, with the process flow chart drawings provided in FIGS. 1A-1D, these two types of feedstock are fed into the alkylation zone to provide the DAB production of the present invention. The aromatic feedstock comprises an aromatic moiety, which is preferably benzene, or alternatively, any aromatic compound including toluene, ethylbenzene, xylene, anisole, naphthalene, methylnaphthalene, or derivates of the above that may be alkylated with Slightly Branched Olefins. The use/selection of aromatic compound other than benzene, however, must be exercised with care as it may limit/alter the degree of alkylation that ultimately will impact the performance characteristics of the DAB base stock composition In an embodiment of the invention, the Slightly Branched Olefins of the present invention can be either terminal, internal, or vinylidene type, or a mixture that contains at least one of such functionality types prepared under the isomerization/alkylation conditions with appropriate catalysts known in the art.

Figure 2:
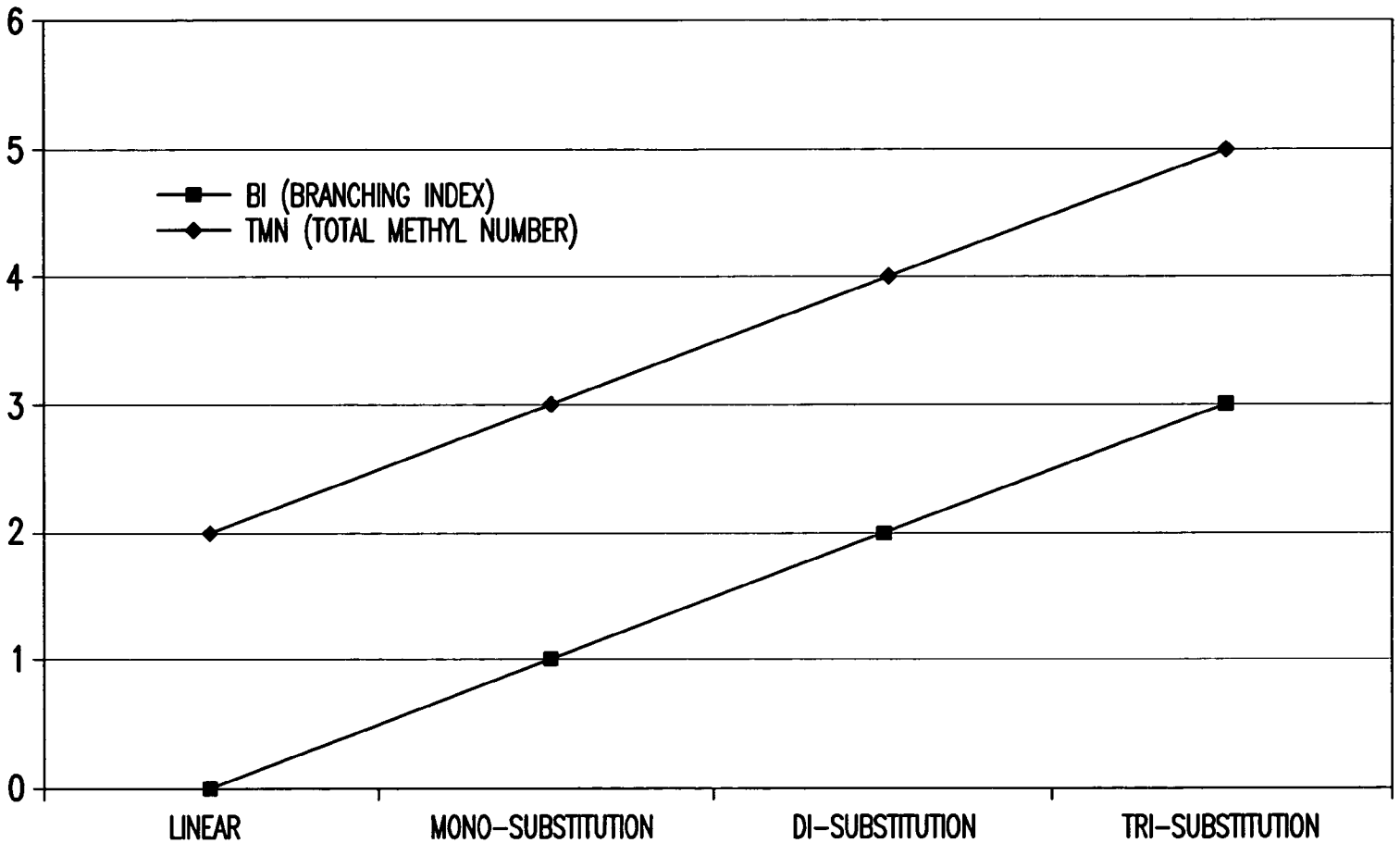
FIG. 2 illustrates the relationship between the total methyl carbon numbers (abbreviated as TMN) and branching index (abbreviated as BI).

FIG. 2 describes the relationship between the total methyl carbon numbers (abbreviated as TMN) and branching index (abbreviated as BI). There are four structural types of carbon groups present in any given hydrocarbon containing molecules, namely methyl, methylene, methine, and quaternary groups. TMN is the total carbon numbers that belong to the structural type of methyl groups on the alkyl side chains of the DAB composition of the present invention. The characterization, assignment, and quantitative determination of methyl groups have been carried out routinely with analytical techniques such as Infrared spectroscopy as disclosed in U.S. Pat. No. 5,922,922 NMR ($H^1$ and $C^{13}$) spectroscopy, or other methods known in the arts. The analytical technique employed by the present invention is based on $C^{13}$ NMR spectroscopic method wherein $C^{13}$ chemical shifts of methyl groups are first identified/assigned by the DEPT techniques, and then areas of these chemical shifts are integrated, with in 5% of experimental error, against the rest of the total aliphatic carbon regions in the spectrum. If the structure of the alkyl side chain is perfectly linear, we expect to see exactly two terminal methyl carbons (and hence TMN=2). Conversely, any TMN value that is greater than two is the result of branching in the molecules. By subtracting two from TMN we obtain the value of branching index that reflects directly the degree of branching in the DAB composition of the present invention.

The Slightly Branched Olefin may comprise a mixture of linear and branched molecules that can be mono-substituted, di-substituted, or tri-substituted wherein its branching characteristics is defined by either TMN or BI values as shown in FIG. 2 and calculated/determined by $C^{13}$ NMR spectroscopic method in accordance with the following equations:

$$TMN = \frac{\text{Averaged chain length}}{\text{Carbon number}} \times \frac{\text{Sum of integrated areas for all methyl groups}}{\text{Total integration area for all aliphatic carbons}}$$

$$BI = TMN \text{ minus } 2(\text{two terminal methyl carbons})$$

Figure 3:
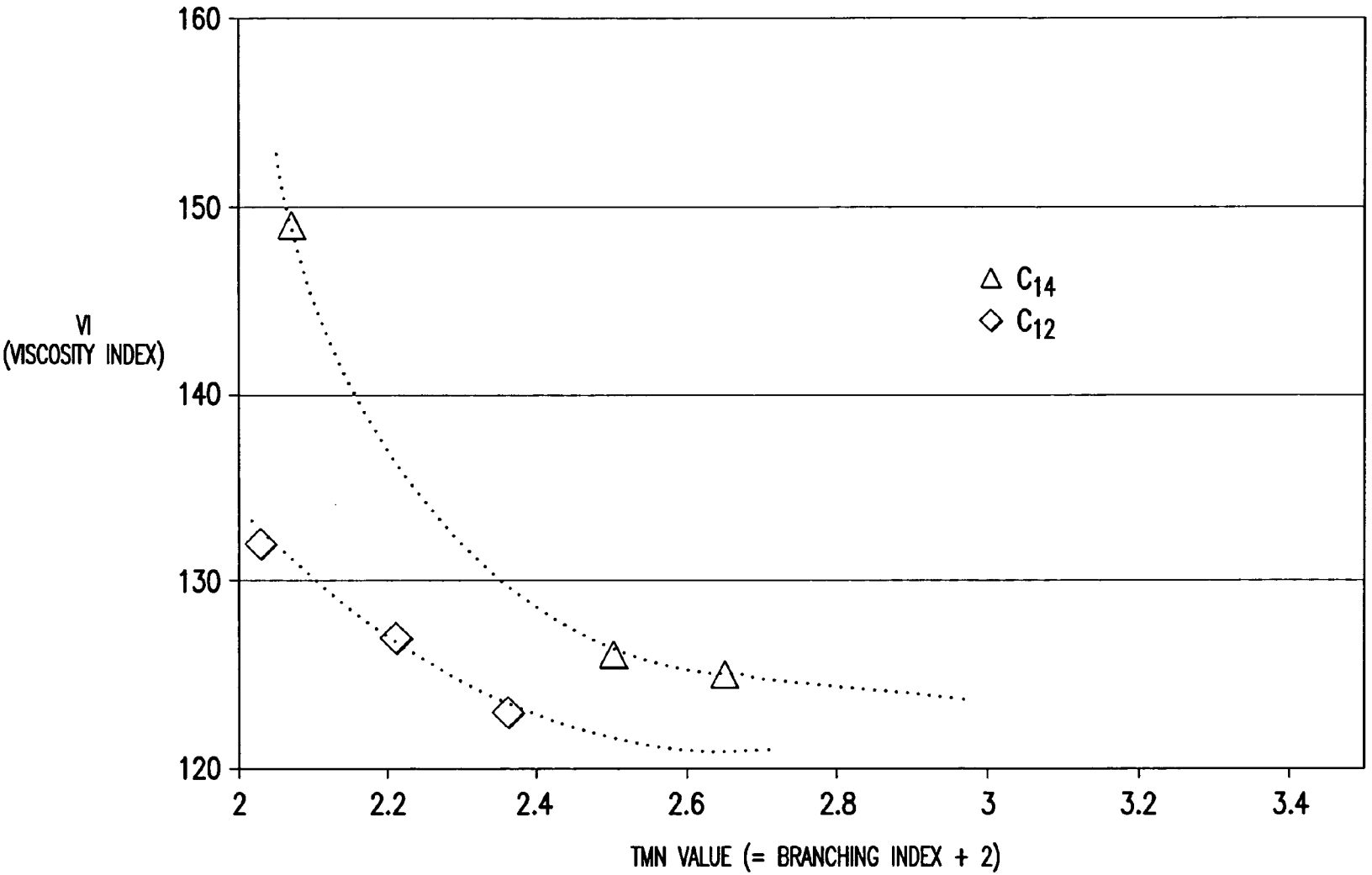
FIG. 3 plots TMN value versus viscometric index of the examples of the present invention, wherein the maximum of TMN values are extrapolated up to 3.5 in order to achieve the minimum viscosity index of 120.

In the field of synthetic lubricant base stock it is known that branching of alkyl side chain structure will significantly reduce/lower the viscometric index of the molecules which is a measure of the linearity of the molecules as well as negatively impact other physical properties such as NOACK volatility. It was found surprisingly that by controlling the branching characteristics of the Slightly Branched Olefins we are able to produce the DAB composition of the present invention with a desired combination of superior performance characteristics including high viscometric index, low NOACK volatility, as well as superior low temperatures. In order to achieve a minimum viscometric index of 120, TMN of the Slightly Branched Olefin of the DA B composition of the present invention, as shown in FIG. 3, was found to be from 2.1 to 3.5, or preferably from 2.15 to 3.25, or even more preferably from 2.2 to 3.0, or by the corresponding BI from more than 0.1 to less than 1.5, or more preferably, 0.15 to 1.25, or even more preferably, 0.25 to 1.0.

The alkyl group branch or branches of the Slightly Branched Olefins can be bonded to any carbon on the aliphatic olefin chain in the molecules and may be selected from methyl, ethyl, propyl, or alike, or a mixture of all of the above. The olefin functionalities of the Slightly Branched Olefins of the present invention can be either terminal (or called alpha), vinylidene, or internal type, or a mixture that contains at least one of such functionality types as described in the general formula of the following:

$$R_1R_2—C{=}C—R_3R_4$$

As used herein, the term of "terminal/alpha olefins" refers to olefins having the chemical formula of $R_1—CH{=}CH_2$ ($R_2$, $R_3$, $R_4$=H). The term of vinylidene refers to olefins having the chemical formula of $R_1R_2—C{=}CH_2$ ($R_3$, $R_4$=H). The term of internal olefins refers to olefins having the chemical formula of $R_1R_2—C{=}CR_3R_4$ (at least one aliphatic, non-hydrogen groups attached to the olefin functionality).

When the NOACK volatility is concerned, the total carbon number of the DAB composition must exceed C26, or more preferably C28, at a concentration more than 90%. By doing so, NOACK volatility is expected to be 13% or less. This dictates the chain length of the alkyl side chain groups to be at least C10, or preferably C11 and above. Another consideration in the selection of chain length of the DAB composition is viscosity. Generally the higher the alkyl chain length, the higher the viscosity grade of DAB composition may be achieved.

The production of Slightly Branched Olefins is not the essential element of the present invention, and without being bonded by any theory, they can be produced by either paraffins dehydrogenation or paraffin/olefin isomerization through shape-selective solid catalysts such as ZSM-5 and ZSM-23 as disclosed in U.S. Pat. No. 4,855,527, or a combination of processes described in Parts 1 and 2 in FIG. 1 and/or any other processes known in the arts to achieve the desire branching characteristics. Such slight branched olefins may also be produced in situ during the alkylation process wherein the olefins may be isomerized and subsequently/simultaneously alkylated in the presence of solid acid alkylation catalysts as described in FIG. 1.

The alkylation process employed to prepare the DAB composition of the present invention may be carried out with a number of alkylation solid catalysts known/skilled in the arts. Examples include clay, amorphous silica-alumina, zeolite, or alike, but shall not be limited to the above.

The DAB composition so prepared, in accordance with the detailed conditions described above, matches and exceeds critical performance characteristics including high viscometric index, low volatility, superior low temperature properties, and improved thermal/oxidation stability unmatched by the heavy alkylate as well as those disclosed in the prior arts of the above. This combination of performance benefits enable its use as a premium synthetic lubricant base stock wherein it can be used as a standalone base stock, a second base oil component, or additive whenever is appropriate.

The DAB composition of the present invention may be further processed through hydro-finishing, clay treated, or processes known in the arts to improve its color and appearance characteristics and to remove residual impurities such as moisture or residual catalyst present. Such additional processing is known in the arts to produce fluids that are more suitable for high sensitive and critical applications such as insulating/cable fluids and refrigeration oils where it requires superior electrical properties.

The performance characteristics of the DAB composition of the present invention can be further improved and expanded by the addition of additive such as antioxidants and other additives known in the trade of lubricant formulations, to meet requirements of specific functions of the intended applications.

In the following examples provided below, alkylation catalyst such as mordenite-type zeolite was used to demonstrate the merits and importance of employing Slightly Branched Olefins for making the DAB composition of the present invention that contain primarily DAB alkylates. For clarity and ease of the discussion that follows, Table 1 assigns fluid ID to each of the examples and comparative examples with key/summary information. It should be understood that discussions provided hereinafter are served for the purpose of illustration and are not meant to limit the scope of this invention to the embodiments shown in the examples.

TABLE 1

Fluid ID and summary process conditions for example provided herein

| Fluid ID | Example - description | Catalyst/Olefin source* |
|---|---|---|
| A | Example 1 - C12 based DAB | Mordenite/IV |
| B | Example 2 - C12 based DAB | Mordenite/IV |
| C | Comparative Example 1 - C12 | Mordenite/M |
| D | Comparative Example 2 - C12 | Mordenite/1:1 C10 (S)/C14 (M) |
| E | Comparative Example 3 - C12 | US Patent example 6,491,809 |
| F | Example 3 - C14 based DAB | Mordenite/M |
| G | Example 4 - C14 based DAB | Mordenite/IV |

TABLE 1-continued

| Fluid ID and summary process conditions for example provided herein | | |
|---|---|---|
| Fluid ID | Example - description | Catalyst/Olefin source* |
| H | Comparative Ex. 4 - C14 | Mordenite/M |
| I | Comparative Ex. 5 - C12/C14/C16 | Mordenite/1:1:1 C14 (M)/C12C16 (S) |
| J | Comparative Example 6 | HF/butene trimers |
| K | Comparative Example 7 | HF/propylene tetramers |
| L | Comparative Example 8 | 4 cSt PAO |
| M | Comparative Example 9 | 6 cSt PAO |
| N | Comparative Example 10 | GIII base oil (ISO 22) |
| O | Comparative Example 11 | GII base oil (ISO 22) |

*Olefin source: IV: Innovene, M: Mitsubishi, S: Shell

EXAMPLES

Example 1

Benzene and dodecene sourced from Innovene ($C_{12}$ alpha olefin purity of 85% and $C_{12}$ branched and vinylidene olefins of 11%) are allowed to react with solid acid catalyst containing 80% mordenite-type zeolite and 20% alumina at a weight hourly space velocity (WHSV)=2 $h^{-1}$ (weight of feedstock to weight of catalyst and per hour) with an inlet temperature of 210° C. The $C_{12}$-based DAB products are separated from the resulting product mixture by distillation to remove mono-alkylbenzene to less than 0.5%. The $C_{12}$-based DAB products are characterized by NMR and other analytical methods.

Example 2

Benzene and dodecene sourced from Innovene with C12 alpha olefin purity of 85% and C12 branched and vinylidene olefins of 11% were reacted according to the same procedure/process conditions given in Example 1 with an inlet temperature of 190° C. The C12-based DAB products are isolated and characterized as described in Example 1

Example 3

Tetra-decenes sourced from Mitsubishi Chemical was isomerized with zeolite catalyst to give the isomerized C14 olefins with alpha olefin purity of 4% and branched and vinylidene olefins of more than 75%. Benzene and pre-isomerized olefins are then reacted according to the same procedure/process conditions given in Example 1 with an inlet temperature of 200° C. The C14-based DAB products are isolated and characterized as described in Example 1

Example 4

Benzene and tetra-decenes sourced from Innovene with alpha olefin purity of 74% and C14 branched and vinylidene olefins of 18% were reacted according to the same procedure/process conditions given in Example 1 with an inlet temperature of 220° C. The C14-based DAB products are isolated and characterized as described in Example 1

Comparative Examples 1, 2, 4, 5

Benzene and C12-C16 olefins sourced from Mitsubishi Chemical (C14) and Shell Chemical (C12, C16) respectively with high alpha olefin purity of more than 90% and branched and vinylidene olefins of less than 5% were reacted according to the same procedure and reaction and catalyst conditions given in Example 1 with specific inlet temperatures given in Table 1 (as well as Tables 2 and 3). The alkylate products of DAB are isolated and characterized as described in Example 1.

Comparative Examples 6-7

Benzene and branched olefins, namely butene trimers and propylene tetramers respectively were allowed to react in the commercial process using HF catalysts. The heavy products was isolated after the removal of mono-alkylates as well as intermediate products between DAB and mono-alkylates and characterized as described in Example 1.

Comparative Examples 8-11

Comparative examples of 8-11 are commercial samples selected for comparison. The composition/catalyst is listed in Table 1. Tables 2, 3 summarize process conditions, branching characteristics of olefins/alkyl side chain, viscometric properties, and performance data on examples provided above.

TABLE 2

| Inspection properties of ISO 22 Viscosity Grade C12 based DAB fluids | | | | | |
|---|---|---|---|---|---|
| | Fluid ID | | | | |
| | A | B | C | D | E |
| | Example No | | | | |
| | Example 1 | Example 2 | Comparative 1 | Comparative 2 | Comparative 3 |
| Process Condition and branching characteristics | | | | | |
| Catalyst | Mordenite | Mordenite | Mordenite | Mordenite | Mordenite |
| Inlet temperature, ° C. | 210 | 190 | 190 | 170 | |
| Alpha olefins, min | 85% | 85% | 95% | 95% | 100% |
| Branched olefins | 11% | 11% | 3% | 3% | |

TABLE 2-continued

| Inspection properties of ISO 22 Viscosity Grade C12 based DAB fluids | | | | | |
|---|---|---|---|---|---|
| | Fluid ID | | | | |
| | A | B | C | D | E |
| | Example No | | | | |
| | Example 1 | Example 2 | Comparative 1 | Comparative 2 | Comparative 3 |
| TMN (1) | 2.36 | 2.21 | 2.09 | 2.03 | 2.0 |
| BI (1) | 0.36 | 0.21 | 0.09 | 0.03 | 0 |
| Viscometric and physical property Data | | | | | |
| 40° C. viscosity, cSt | 22.2 | 22.3 | 22.2 | 22.1 | 21.16 |
| VI | 123 | 127 | 131 | 132 | 130 |
| pour point, ° C. | −59 | −53 | 41 | −22 | −9 |
| CCS, cp@ −40° C. (2) | 7,000 | 14,000 | Frozen | Frozen | NR* |
| Structural Analysis | | | | | |
| ortho | 9% | 7% | 7% | 5% | 5% |
| meta | 40% | 29% | 27% | 13% | 5% |
| para | 51% | 65% | 65% | 82% | 90% |
| 2,2 linear isomer (3) | 12.0% | 25.0% | 40.0% | 55.0% | >50% |
| Performance Data | | | | | |
| NOACK(4) | 10% | 9% | 8.5% | 8.3% | NR* |
| Aniline point, ° C. (6) | 78 | 80 | 80 | 80 | NR* |

(1) BI/TMN - determined by C13 NMR integration
(2) CCS: Cold cranking simulated viscosity: ASTM D5293
(3) Determined by GC Chromatography
(4) NOACK: ASTM D5800B
(5) SMDS: ASTM D2887
(6) Aniline point: ASTM D611
*U.S. Pat. No. 6,491,809, table 3, NR: not reported

TABLE 3

| Inspection properties of ISO 32 Viscosity Grade C14 based DAB fluids | | | | |
|---|---|---|---|---|
| | Fluid ID | | | |
| | F | G | H | I |
| | Example No | | | |
| | Example 3 | Example 4 | Comparative 4 | Comparative 5 |
| Process Condition and branching characteristics | | | | |
| Catalyst | Mordenite | Mordenite | Mordenite | Mordenite |
| Inlet temperature, ° C. | 200 | 220 | 180 | 200 |
| Alpha olefins, min | 4% | 74% | 94% | 95% |
| Branched and vinylidene olefins | 75% | 18% | 4% | 5% |
| TMN (1) | 2.65 | 2.5 | 2.07 | 2.12 |
| BI (1) | 0.65 | 0.5 | 0.07 | 0.12 |
| Viscometric and physical property Data | | | | |
| 40° C. viscosity, cSt | 34.9 | 29.8 | 29.4 | 29.9 |
| VI | 125 | 126 | 149 | 147 |
| pour point, ° C. (ASTM D5950) | −58 | 40 | 0 | −22 |
| CCS, cp @ −40° C. | 17,000 | 14,500 | Frozen | Frozen |
| Structural Analysis | | | | |
| ortho | 7% | 9% | 6% | 7% |
| meta | 23% | 38% | 19% | 21% |
| para | 69% | 52% | 75% | 72% |
| 2,2 linear isomer (2) | 1.6% | 7.4% | 41.9% | 35% |
| Performance Data | | | | |
| NOACK (3) | 6.3% | 7.6% | 3.8% | 3.6% |

(1) BI/TMN - determined by C13 NMR integration
(2) Determined by GC Chromatography
(3) NOACK: ASTM D5800B It can be readily seen in Comparative Examples 1-3 (Fluids C/D/E, see Table 1&2), that the use of mordenite and commercially available C12 linear alpha olefins (pure alpha olefin used in Comparative Example 3) gives DAB with high 2-linear isomer content and thereby high viscometric index but fails consistently to give good low temperature properties as measured by cold cranking simulated/CCS viscosity at −40° C. CCS is the critical test required to exemplify the pumpability and start up ability of the lubricant at low temperatures. By increasing the branching characteristics of the olefins feed (Fluids C to B) and inlet temperature of the process (from Fluids D to A), we are able to produce DAB in high yields while retaining high viscometric index with much improved CCS properties at −40° C. Such improvements are unexpected since branching is known to lower viscometric index significantly and reduce the alkylation reactivity of the olefins in the solid acid catalyst process presumably due to the increased bulkiness of the molecules. $C^{13}$ NMR further confirms the consistent increase (from Fluids C to A) of the branching characteristics of the alkyl side chain of said dialkyl benzene component. Increase of the meta isomer in the DAB products at elevated temperature (from Fluids C to A) is consistent with meta isomer being a more thermodynamically favored product, however, does not appear to play a significant role in contributing to the improved low temperature properties (isomer distribution is essentially the same between Fluids B and C). Another surprise element is the significant reduction of 2-linear isomer (Fluids A/B) and para isomer, which were thought to be the root cause of the high viscometric index, however, does not appear to impact/degrade the viscometric properties of said dialkyl benzene component in the present invention.

Subsequently, in the case of C14 based DAB (Table 3), the same trend of increase branching due to increased process inlet temperature (from 180° C. (Fluid H) to 220° C. (Fluid G)) is observed. Again marked improvements of low temperature properties (pour points from 0° C. to −40° C.) are seen. To verify the effect of branching, linear olefin is preisomerized and alkylation at a lower process temperature (200° C.—Fluid F) is carried out. This provides further improvements on low temperature properties (pour point from −40° C. to −58° C.) while maintaining good viscometric index. Lowered processing temperature improves catalyst aging and reduces the likelihood of undesired side reactions.

Fluid I is an example wherein a mixture of linear olefin was used in the preparation of DAB. Such an approach, which is commonly employed in the arts to tailor/optimize base oil properties, gives some improvements on pour points, however, fails to give measurable CCS viscosity at −40° C.

To illustrate the importance of the slight/controlled degree of branching, Fluid J and K based on BT (BI of approximately 2) and PT (BI of approximately 3) olefins respectively using HF catalyst are provided for comparative purpose. The alkylate products isolated after the removal of mono-alkylates and light ends were found to contain DAB as well as tri-alkylated products. Results given in Table 4 showed that they have low/unacceptable volatility and far inferior viscometric index characteristics than DAB prepared by the present invention.

Further comparisons with commercial base oils are provided in Table 4 wherein it shows Fluids A (C12 DAB) and F (C14DAB) matches and exceeds critical performance characteristics of PAO as well GIII/GII hydrocracked fluids including high viscometric index, low volatility, superior low temperature properties, and solvency toward additives (determined by aniline point) that makes it suitable as a premium synthetic base stock.

The branching relationship between TMN and BI given in FIG. 2 can be further illustrated in the Table 5 below that include present examples as well those known in the arts. Higher carbon numbers of alkyl side chain of said dialkyl benzene is expected to give higher viscometric index. C14 based DAB of the present invention at a higher TMN (2.5-2.6) gives VI comparable with C12 based DAB with lower TMN (2.1-2.4). Higher TMN is anticipated with higher alkyl side chains. Furthermore, it is conceivable that by blending/mixing olefins from different BI category groups one can achieve the desired branching as described in the present invention.

TABLE 5 branching characteristic/category of olefins for Fluids A-J

| TMN | BI | Examples known in the arts | Examples given in the present invention |
|---|---|---|---|
| 2 | 0 | Linear alpha olefins | BI < 0.1: Fluids C, D, E, H, I |
| 3 | 1 | Hexene dimmers | 0.1 < BI < 1: Fluids A, B, F, G |
| 4 | 2 | Butene trimers | Fluid J |
| 5 | 3 | Propylene tetramers | Fluid K |

The invention being thus described generically and with reference to specific embodiments, it will be readily apparent to those skilled in the art that the same may be varied in many ways. All such variations are encompassed by the spirit of the invention, the patented scope of which is demarcated in the appended claims.

TABLE 4 comparative data with commercial DAB, PAO, and mineral oil based products

| | Fluid ID | | | | | | | |
|---|---|---|---|---|---|---|---|---|
| | A | F | J | K | L | M | N | O |
| | Example No | | | | | | | |
| | E-1 | E-3 | C-6 | C-7 | C-8 | C-9 | C-10 | C-11 |
| Composition | C 12 DAB | C 14 DAB | BT Bottom | PT Bottom | PAO 4 | PAO 6 | GII | GII |
| TMN | 2.36 | 2.65 | ~4 | ~5 | | | | |
| ISO viscosity grade | 22 | 32 | 46 | 46-68 | 15-22 | 32 | 22 | 22 |
| 40° C. viscosity, cSt | 22.2 | 34.9 | 48.7 | 53.7 | 17 | 30 | 19 | 20.4 |
| VI | 123 | 125 | 20 | 4 | 124 | 135 | 127 | 102 |
| Pour point, ° C. | −59 | −58 | −43 | −35 | −73 | −61 | −18 | −14 |
| NOACK (1) | 9% | 4% | >30% | >30% | 13% | 7% | 14% | 26% |
| Aniline point, C. (2) | 78 | 87 | 71 | 67 | 118 | 125 | 120 | 115 |

(1) NOACK volatility: ASTM D5800B (2) Aniline point: ASTM D611

What is claimed is:

1. A synthetic base oil composition comprising a dialkyl aromatic compound made via a one-step process by reacting benzene with olefins, wherein said synthetic base oil composition has a minimum viscosity index of 120, a maximum pour point at −40° C., a Selby-NOACK volatility of no higher than 13%, and a cold cranking stimulated viscosity at −40° C. of no higher than 20,000 cp, wherein said dialkyl aromatic compound has two alkyl substituents of carbon chain length from $C_{11}$ to $C_{18}$ and the content of total 2-positional linear isomers in the dialkyl aromatic compound is within a range from 1.6% to no more than 25%, and wherein the branching characteristics of said alkyl substituents has a total methyl number ("TMN") determined by $C^{13}$ NMR spectroscopy of from more than 2.15 to less than 3.25 or has a branching index ("BI") of from more than 0.15 to less than 1.25, wherein TMN is calculated by dividing the sum of integrated areas for all methyl groups by the total integration area for all aliphatic carbons and multiplying the result by the averaged chain length carbon number, and wherein BI is TMN minus 2 (two terminal methyl carbons).

2. The synthetic base oil composition of claim 1, wherein the content of dialkyl aromatic compound is at least 85% by weight, based on the total weight of the synthetic base oil composition.

3. The synthetic base oil composition of claim 1, wherein the nucleus of said dialkyl aromatic compound is a member selected from the group consisting of benzene, toluene, and anisole.

4. The synthetic base oil composition of claim 1, wherein the carbon number of said alkyl substituents is from $C_{12}$ to $C_{18}$.

5. The synthetic base oil composition of claim 1, wherein the TMN of said dialkyl aromatic compound is from 2.2 to 3.0 or wherein the BI is from 0.2 to 1.0.

6. The synthetic base oil composition of claim 1, wherein said synthetic base oil composition further comprises additional synthetic alkylates which are linear or branch types.

7. The synthetic base oil composition of claim 1, wherein said synthetic base oil composition further comprises a second synthetic base oil selected from the group consisting of polymerized alpha olefin base oil and mineral oil, or further comprises a lubricant additive.

8. A method of making the synthetic base oil composition of claim 1, comprising a step of alkylating aromatic compounds with olefins that are pre-isomerized through an isomerization zone to achieve the branching characteristics required for the alkyl substituents.

9. The method of claim 8, wherein the alkylating step is carried out in the presence of solid acid catalyst selected from the group consisting of clay, amorphous silica-alumina, and zeolite.

10. The method of claim 9, wherein the olefin is pre-isomerized, which pre-isomerization is carried out simultaneously with the alkylating step.

11. The method of claim 8, wherein said olefin is prepared by the steps of:

a) isomerizing a paraffin to produce an isoparaffin, b) dehydrogenating the resulting isoparaffin-containing stream to produce a mono-olefin-containing stream, and c) selectively hydrogenating the mono-olefin stream to remove dienes and to produce mono-olefins having the specified branching characteristics required for said alkyl side chains.

12. The method of claim 8, wherein said olefin is prepared by the step of conducting a shape-selective olefin oligomerization and/or isomerization process to produce mono-olefins having the specified branching characteristics required for said alkyl side chains.

13. The method of claim 8, where said olefin is prepared by the step of:

conducting a Fischer-Tropsch process to produce mono-olefins having the specified branching characteristics required for said alkyl substituents.

14. The method of claim 8, where said olefin is prepared by the step of:

blending and/or mixing linear and branch olefins to produce mono-olefins having the specified branching characteristics required for said alkyl substituents.

15. The product of the process of claim 8.

16. The method of claim 8, wherein the olefins that are pre-isomerized comprise mixtures of olefins of linear, terminal, internal, vinylidene, or branch type or a mixture thereof.

17. A method of making a synthetic base oil composition comprising a dialkyl aromatic compound via a one-step process by reacting benzene with olefins, wherein said synthetic base oil composition has a minimum viscosity index of 120, a maximum pour point at −40° C., a Selby-NOACK volatility of no higher than 13%, and a cold cranking stimulated viscosity at −40° C. of no higher than 20,000 cp, wherein said dialkyl aromatic compound has two alkyl substituents of carbon chain length from $C_{11}$ to $C_{18}$ and the content of total 2-positional linear isomers in the dialkyl aromatic compound is within a range from 1.6% to no more than 25%, and wherein the branching characteristics of said alkyl substituents has a total methyl number ("TMN") determined by $C^{13}$ NMR spectroscopy of from more than 2.15 to less than 3.25 or has a branching index ("BI") of from more than 0.15 to less than 1.25, wherein TMN is calculated by dividing the sum of integrated areas for all methyl groups by the total integration area for all aliphatic carbons and multiplying the result by the averaged chain length carbon number, and wherein BI is TMN minus 2 (two terminal methyl carbons);

said method comprising:

a step of alkylating aromatic compounds with olefins that are pre-isomerized through an isomerization zone to achieve the branching characteristics required for the alkyl substituents.

* * * * *